US008820802B1

(12) United States Patent
Dodson

(10) Patent No.: US 8,820,802 B1
(45) Date of Patent: Sep. 2, 2014

(54) LATCH

(76) Inventor: Donald Ray Dodson, Douglasville, GA (US)

( * ) Notice: Subject to any disclaimer, the term of this patent is extended or adjusted under 35 U.S.C. 154(b) by 167 days.

(21) Appl. No.: 13/238,251

(22) Filed: Sep. 21, 2011

(51) Int. Cl.
*E05C 19/10* (2006.01)

(52) U.S. Cl.
USPC ..... 292/95; 292/1

(58) Field of Classification Search
CPC .... E05B 65/006; E05B 53/005; E05B 13/002
USPC ..... 292/1, 95, 125, 246, 101, 141, 235, 292/262, 264, 265, 270, 271, 276, DIG. 29
See application file for complete search history.

(56) References Cited

U.S. PATENT DOCUMENTS 1,397,459 A * 11/1921 Schmele ..... 292/247
2,747,910 A * 5/1956 Salmon ..... 292/247
3,134,252 A * 5/1964 Mintz ..... 70/93
3,761,118 A * 9/1973 Westcott ..... 292/1
4,422,678 A * 12/1983 Tuckett et al. ..... 292/264
5,876,075 A * 3/1999 Barthelmess, Jr. ..... 292/247
7,178,841 B1 * 2/2007 Moreno ..... 292/327
2004/0130164 A1 * 7/2004 Burch ..... 292/246
2010/0098485 A1 * 4/2010 Womack ..... 403/375

* cited by examiner

*Primary Examiner* — Kristina Fulton
*Assistant Examiner* — Nathan Cumar
(74) *Attorney, Agent, or Firm* — B. Craig Killough; Barnwell Whaley Patterson & Helms

(57) ABSTRACT

A latch has a hook having, in turn, an arcuate portion and a stem. An annular member pivots within a void formed in the stem of the hook. A portion of the annular member is retained within the interior of the arcuate portion of the hook. The annular member is large enough so that it is retained within the arcuate portion of the hook. With the opening of the arcuate portion of the hook opening toward a lower portion of the hook, the annular member will fall against, and be retained within, the arcuate portion of the hook that is opposite the stem of the hook.

7 Claims, 3 Drawing Sheets

LATCH

FIELD OF THE INVENTION

This invention relates to latching devices.

BACKGROUND OF THE INVENTION

Chains, ropes and lines are commonly used for securing doors, gates, and similar openings in structures such as buildings and fences. Latching devices are in common use, and come in a wide variety of structures.

Chains, ropes and lines may be connected to a fixed member, such as a wall or a fence, and be placed around, or be connected to, a hinged opening, such as a gate or a door. For example, a chain may be connected to a fence, to pass through a post in a gate, and then secured again to the fence.

Latches which are used with chains or ropes to secure gates or doors may be difficult to manipulate. Frequently, such latches require two hands to position or remove the latch to open the gate or door, or two hands to reposition the chain or line to the latch. If a person attempting to open or close the door or gate using the latch has articles in one hand, then it is cumbersome to manipulate the closure device for the gate or door. Accordingly, there is a need for a latch that is useful with a chain or line and which can be easily manipulated with one hand.

SUMMARY OF THE INVENTION

The present invention is a hook having an arcuate portion and a stem. An annular member pivots within a void formed in the stem of the hook. A portion of the annular member is retained within the interior of the arcuate portion of the hook. The annular member is large enough so that it is retained within the arcuate portion of the hook. With the opening of the arcuate portion of the hook opening toward a lower portion of the hook, the annular member will fall against, and be retained within, the arcuate portion of the hook that is opposite the stem of the hook.

A receiver, which is a separate member, is retained between the annular member and the arcuate portion. The annular member may be easily pivoted relative to the stem to provide an opening between the annular member and the arcuate portion of the hook so that the receiver member may be disengaged from the hook. Lines, such a chain or rope, may be attached to the hook, with the opposite end of the chain or line connected to a shank or hook structure.

DESCRIPTION OF PREFERRED EMBODIMENTS

Figure 1:
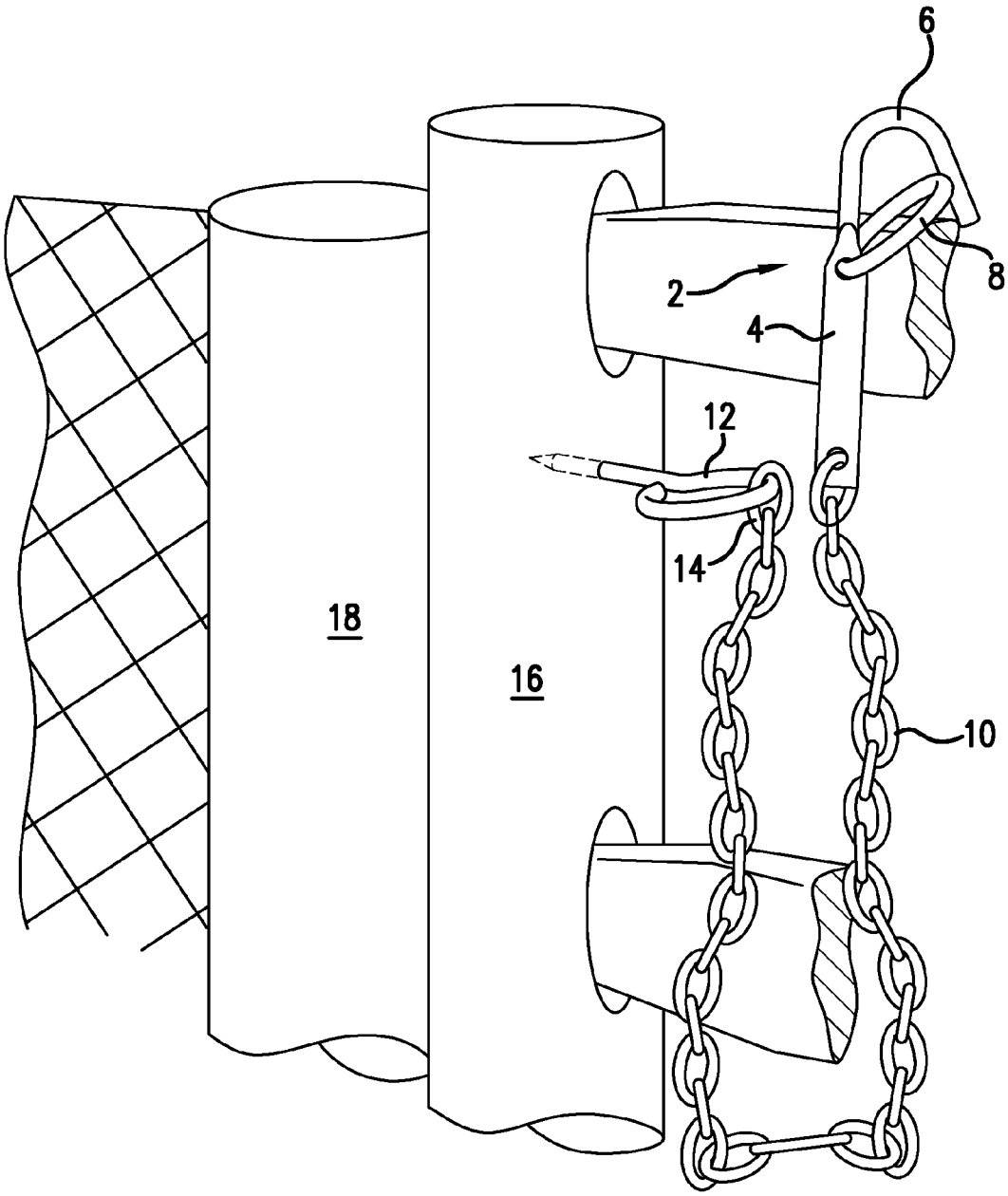
FIG. 1 demonstrates the latch of the present invention, with a chain attached to the hook and to the receiver member, which is mounted on a fence post.

Turning to the drawing figures, the latch of the present invention is preferred to comprise a hook 2 comprising a lower stem 4 and an upper arcuate portion 6. FIG. 1. In a preferred embodiment, the hook is formed generally in the shape of an inverted "J," opening toward a lower portion of the hook. The stem extends downwardly and beyond the arcuate portion of the hook.

An annular member 8 pivotally engages the hook. In one embodiment, the annular member is round, and has a smaller diameter than the upper arcuate portion of the hook which the annular member engages. This substantially round annular member of this embodiment has a diameter that is sufficiently large so that the annular member falls against, and is retained within, an interior portion of the arcuate portion of the hook that is opposite the stem, as demonstrated in FIG. 1. The annular member is sufficiently large such that it falls against, and not out of, the opening formed in the arcuate portion of the hook. "Annular" means that the annular member has no gap in the ring or loop that is sufficiently large to permit the receiver member to pass though the gap, although a completely annular member with no gap is preferred.

A line 10 is attached to the lower end of the hook in the embodiment as shown. A line, such as a nylon line, or a rope may be used; however, chain is preferred, since metal chain provides weight that helps to hold the hook in position in the receiver member 12. An opposite portion, or end 14, of the chain may also be connected or attached to the receiver member. The receiver member may be mounted on a fence or similar structure, such as a fence post 16. The chain may be somewhat permanently mounted to the receiver member, such as by leaving a threaded eye for the receiver member that is screwed into the fence post, with the chain engaging the eye as shown in the drawing figures. Other configurations for mounting the chain to the fence or structure may be used.

Figure 2:
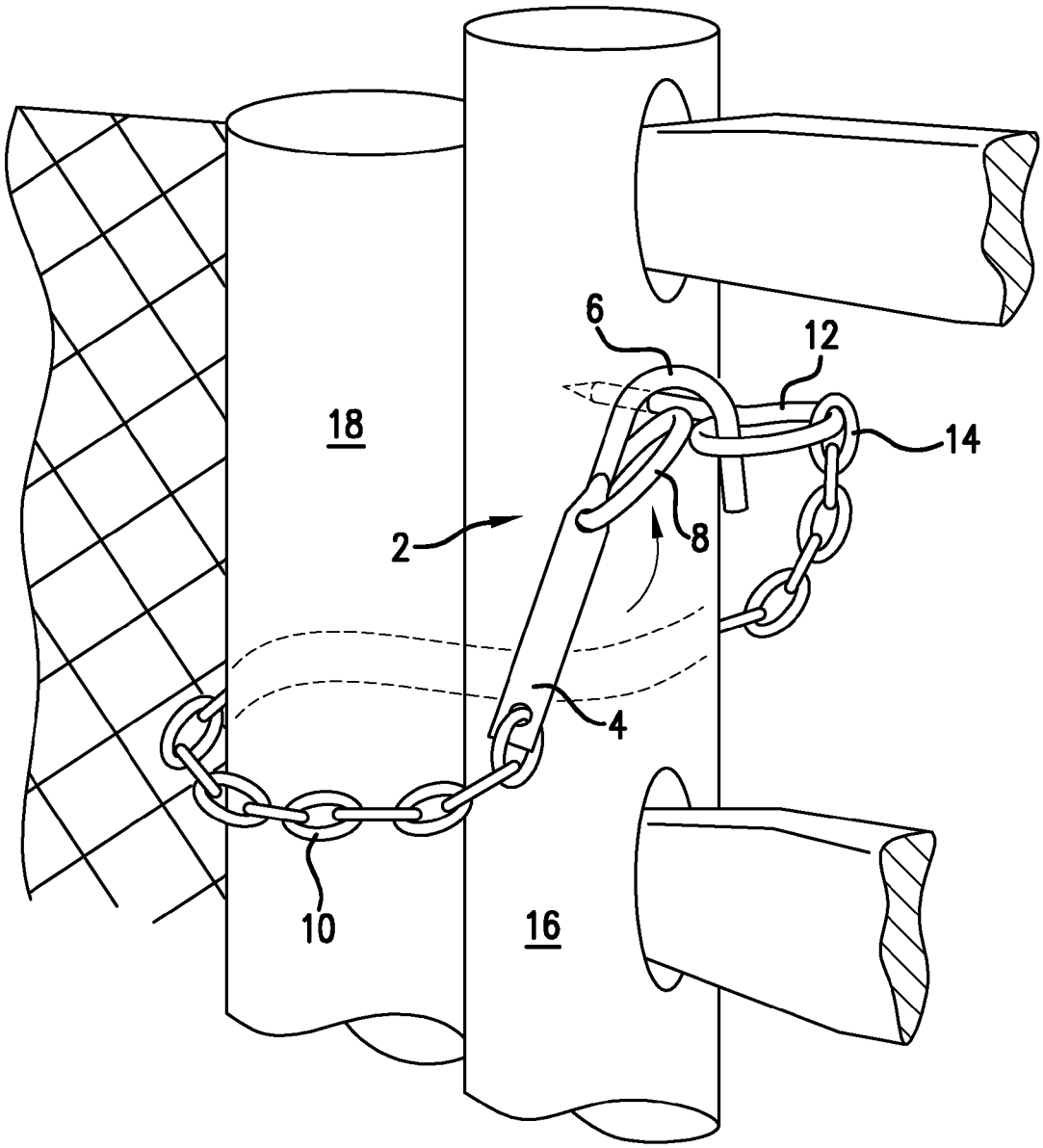
FIG. 2 demonstrates the hook being positioned in the receiver member, with a chain positioned around a gate to retain the gate in a closed position relative to the fence post.

In use, the chain is looped around the opening, such as the gate 18 or other opening in a structure such as a fence. FIG. 2. The latch may be positioned simply by engaging the end of the arcuate portion with the receiver member 12, such as a hook eye 42, so that the receiving member is between opposite sides of the arcuate portion. The weight of the hook, and the associated chain, will cause the hook to fall in the position shown in FIG. 3, where the receiver member rests within and against an upper portion of the opening in the arcuate portion of the hook. As the hook falls, the receiver member pushes the pivoting annular member out of its path. FIG. 2. However, when the receiver member reaches the upper part of the arcuate portion of the hook, it has moved past the annular member, and the pivoting annular member falls against a side of the arcuate portion of the hook. The latch now retains the chain in position, with the chain holding the gate. In the event that a force is applied to the gate, such as by livestock, the chain holds the gate in position, with the hook and receiver member holding the chain in place. The hook will not disengage from the receiver member, since the hook is held in place, being surrounded by the annular member, and by the arcuate portion of the hook.

In use, the chain is looped around the opening, such as the gate 18 or other opening in a structure such as a fence. FIG. 2. The latch may be positioned simply by engaging the end of the arcuate portion with the receiver member, such as a hook eye 12, so that the receiving member is between opposite sides of the arcuate portion. The weight of the hook, and the associated chain, will cause the hook to fall in the position shown in FIG. 3, where the receiver member rests within and against an upper portion of the opening in the arcuate portion of the hook. As the hook falls, the receiver member pushes the pivoting annular member out of its path. FIG. 2. However, when the receiver member reaches the upper part of the arcuate portion of the hook, it has moved past the annular member, and the pivoting annular member falls against a side of the arcuate portion of the hook. The latch now retains the chain in position, with the chain holding the gate. In the event that a force is applied to the gate, such as by livestock, the chain holds the gate in position, with the hook and receiver member holding the chain in place. The hook will not disengage from the receiver member, since the hook is held in place, being surrounded by the annular member, and by the arcuate portion of the hook.

The latch is engaged to retain the gate with one hand by simply dropping the end of the arcuate portion of the hook into the receiver member, and gravity secures the latch to the receiver member. No further manipulation is required to secure the latch and the associated gate.

Figure 3:
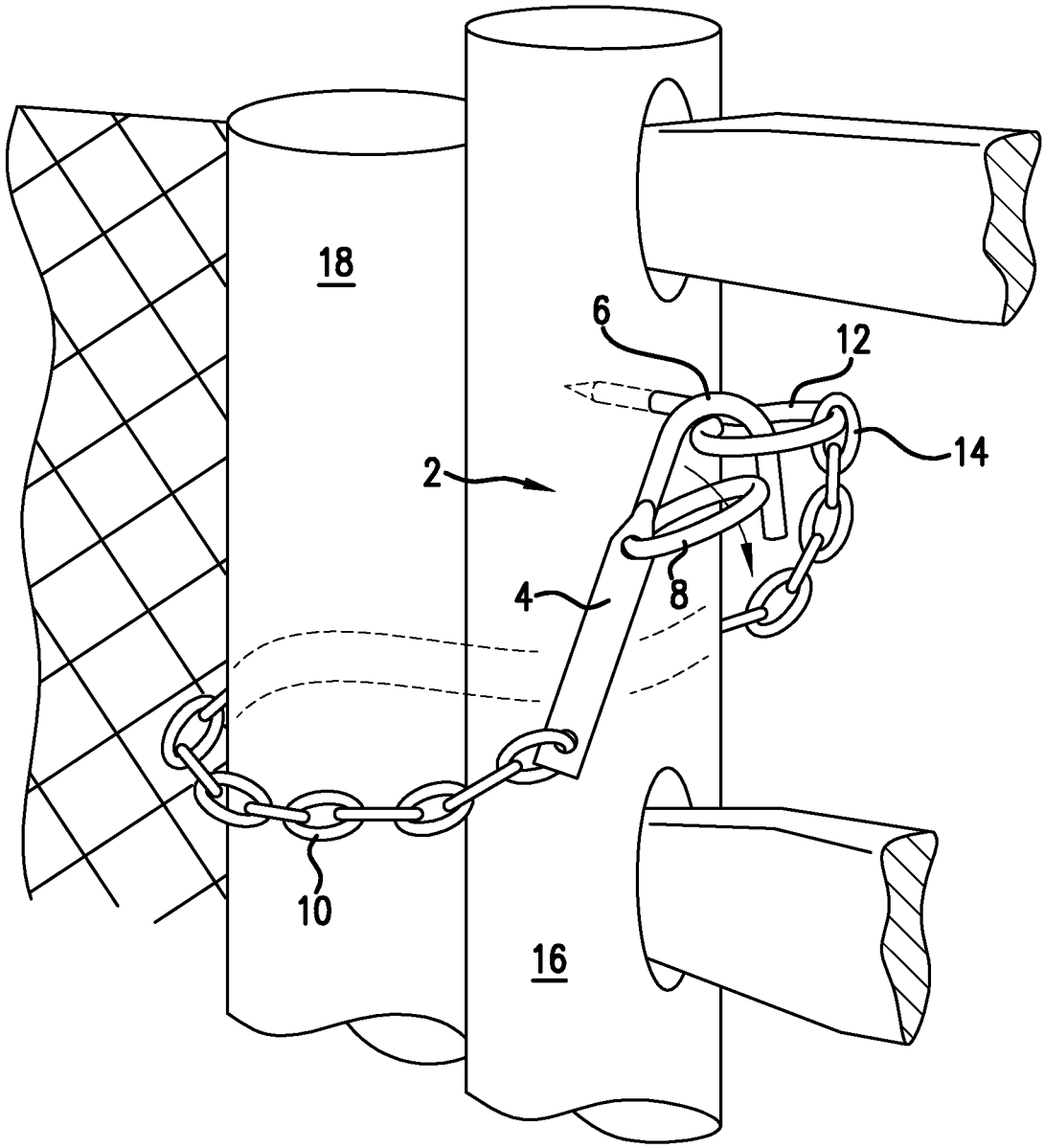
FIG. 3 shows the annular member retained by the arcuate portion of the hook, with the receiver member positioned within the arcuate portion of the hook.

To disengage the hook from the receiver member, it is necessary only to pivot the annular member upward to the position shown in FIG. 2 while the receiver member is near a top portion of the arcuate portion of the hook. The annular member may be pivoted past the receiver member. The structure of the device is such that the annular member can be pivoted sufficiently toward the side of the hook on which the stem is located to produce adequate space to move the hook upwardly relative to the receiver member, and disengage the hook from the receiver member. The annular member must be sized accordingly, so that it is sufficiently large to contact the hook on the side opposite the stem to hold the hook in position relative to the receiver member, while not being so large as to interfere with removal of the hook from the receiver member when the annular member is pivoted in the opposite direction. Similarly, the annular portion of the hook must also provide sufficient depth to permit the annular member to be pivoted without interference, while having a sufficiently narrowed distance between the sides of the arcuate portion of the hook so that the annular member rests against and is retained within the arcuate portion of the hook, and participate with the receiver member to secure the latch as shown in FIG. 3.

When the hook is not in use, in many applications, the hook may be positioned against the horizontal portion, or other portions, of the fence, as shown in FIG. 1. The inverted "J" provides an opening that allows the hook to rest against various devices, without requiring manipulation of the annular member to remove the hook.

What is claimed is:

1. A latch, comprising:

a hook, the hook comprising a first side and a second side that is opposite the first side, the first side being longer than the second side, the first side and the second side being joined together by an arcuate portion of the hook, the first side comprising a stem that joins the arcuate portion of the hook, wherein, in use, the hook has a space between and defined by the first side, the second side and the arcuate portion of the hook, the hook having an opening on a lower portion of the hook, wherein the opening of the hook communicates with the space, wherein the opening is opposite the arcuate portion of the hook and is present between the first side and the second side of the hook;

wherein the stem has a void therein, and wherein, in use, the stem extends downwardly from the arcuate portion of the hook and below the arcuate portion of the hook;

an annular member that pivots within the void of the stem of the hook, wherein the annular member is positioned within the space of the hook and the annular member is of sufficient size to extend from the void in the stem of the hook and to contact the second side of the hook, and the annular member is retained within the void of the stem of the hook, wherein, in use, a portion of the annular member that is opposite a portion of the annular member that engages the void of the stem of the hook contacts the second side of the hook and the annular member is retained within the space of the hook by contact of the annular member with the second side of the hook;

a receiver member, wherein, in use, the receiver member engages the space of the hook, and the receiver member is present within a portion of the space of the hook, the portion of the space of the hook defined by the first side, the second side, and the arcuate portion of the hook and the annular member;

wherein the stem of the hook is directly connected to one end of a line and an other end of the line directly engages the receiver member.

2. A latch as described in claim 1, wherein the annular member is a round loop.

3. A latch as described in claim 1, wherein the line is a chain.

4. A latch as described in claim 1, wherein the arcuate portion of the hook is approximately a semi circle.

5. A latch as described in claim 1, wherein the hook is "J" shaped, and in use, the "J" shape is inverted.

6. A latch as described in claim 1, wherein the diameter of the annular member is larger than a diameter of the arcuate portion of the hook to retain the annular member within the arcuate portion of the hook.

7. A latch as described in claim 1, wherein, in use, a portion of the annular member that is opposite a portion of the annular member that engages the void in the hook is above the portion of the annular member that engages the void in the hook and rests against the arcuate portion of the hook.

* * * * *